US012779313B1

(12) United States Patent
Partlo

(10) Patent No.: US 12,779,313 B1
(45) Date of Patent: Nov. 3, 2026

(54) THUMBHOLE BOXING GLOVE

(71) Applicant: Loren George Partlo, Coleman, MI (US)

(72) Inventor: Loren George Partlo, Coleman, MI (US)

( * ) Notice: Subject to any disclaimer, the term of this patent is extended or adjusted under 35 U.S.C. 154(b) by 122 days.

(21) Appl. No.: 19/255,483

(22) Filed: Jun. 30, 2025

(51) Int. Cl.
*A63B 71/14* (2006.01)
*A41D 19/00* (2006.01)

(52) U.S. Cl.
CPC ..... *A63B 71/145* (2013.01)

(58) Field of Classification Search
CPC ..... A63B 71/145
See application file for complete search history.

(56) References Cited

U.S. PATENT DOCUMENTS 404,929 A * 6/1889 O'Sullivan ..... A63B 71/145 2/18
608,434 A * 8/1898 Wood ..... A63B 71/145 2/18
1,570,960 A * 1/1926 Gately ..... 2/18
1,598,718 A * 9/1926 Healy ..... A63B 71/145 2/18
1,627,382 A * 5/1927 Golomb ..... A63B 71/145 2/18
1,739,013 A * 12/1929 Mitchell ..... A63B 71/145 2/18
1,746,622 A * 2/1930 Till ..... A63B 71/145 2/18
1,792,004 A * 2/1931 Dieterle ..... A63B 71/145 2/18
2,451,685 A * 10/1948 Moilanen ..... A63B 71/145 2/18
2,574,086 A * 11/1951 Broderick ..... A63B 71/145 2/18
3,540,059 A * 11/1970 Kennedy ..... A63B 71/145 2/18
3,855,633 A * 12/1974 Rhee ..... A63B 71/145 473/518
3,945,045 A * 3/1976 Rhee ..... A63B 71/14 2/18
4,095,294 A * 6/1978 Winterbottom ..... A63B 71/145 2/18

(Continued)

*Primary Examiner* — Robert H Muromoto, Jr.

(57) ABSTRACT

A boxing glove designed for training or competition featuring a biomechanically integrated compression system that improves anatomical alignment, joint stabilization, and impact mitigation. The glove includes an internal thumb channel that guides the thumb beneath the index and middle fingers, promoting natural fist formation and generating fist tension. A wrist tightening strap extends through the glove body, applying radial compression with dorsal and volar pressure centers. A butterfly-style forearm closure system applies anatomically balanced circumferential compression. In molded embodiments, an integrated air-based dampening system includes an air bladder and pressure-release valve to reduce impact force. Both sewn and molded versions preserve the external appearance of traditional boxing gloves while converting passive structures into active biomechanical supports. The invention enhances glove rigidity, reduces joint strain, and improves strike alignment during use.

20 Claims, 3 Drawing Sheets

(56) References Cited

U.S. PATENT DOCUMENTS 4,295,228 A * 10/1981 Dragomir ..... A63B 71/145 2/18
4,445,507 A * 5/1984 Eisenberg ..... A63B 71/143 2/161.1
4,457,023 A * 7/1984 Easterday ..... A63B 71/145 2/161.1
4,603,439 A * 8/1986 Golomb ..... A63B 71/145 2/18
4,635,300 A * 1/1987 Rhee ..... A63B 71/145 D29/113
4,787,376 A * 11/1988 Eisenberg ..... A61F 5/05866 128/880
6,006,358 A * 12/1999 Keating ..... A63B 71/148 473/464
6,093,165 A * 7/2000 Estwanik ..... A63B 71/145 2/161.7
6,119,267 A * 9/2000 Pozzi ..... A41D 13/088 2/161.1
6,941,578 B2 * 9/2005 Anderson ..... A63B 71/143 2/19
7,278,170 B2 * 10/2007 Anderson ..... A63B 71/143 2/21
7,904,967 B1 * 3/2011 Cummings ..... A63B 71/145 2/18
8,657,771 B2 * 2/2014 Weaver, II ..... A61F 5/0118 602/22
9,079,093 B2 * 7/2015 Clement ..... A63B 71/145
10,004,975 B2 * 6/2018 Clement ..... A63B 71/145
10,376,770 B2 * 8/2019 Wittman ..... A63B 71/145
10,799,417 B1 * 10/2020 Carr ..... A61H 7/003
11,344,788 B1 * 5/2022 Wittman ..... A63B 71/145
2005/0193464 A1 * 9/2005 Hess ..... A41D 19/01582 2/160
2008/0263747 A1 * 10/2008 DeBlasis ..... A41F 1/06 2/163
2015/0096215 A1 * 4/2015 Somogy ..... F41C 23/16 42/71.01
2016/0367881 A1 * 12/2016 Le ..... A41F 1/06
2017/0282048 A1 * 10/2017 Wittman ..... A63B 71/145
2020/0345089 A1 * 11/2020 Boss ..... A41D 19/015
2021/0016153 A1 * 1/2021 Roddy ..... A41D 19/0044
2022/0118343 A1 * 4/2022 Olaoluwa ..... A63B 21/4019
2023/0284717 A1 * 9/2023 Williams ..... A41D 19/0048
2024/0424380 A1 * 12/2024 Neubauer ..... A63B 71/145
2025/0221478 A1 * 7/2025 Ringler ..... A41D 19/01

* cited by examiner

THUMBHOLE BOXING GLOVE

CROSS-REFERENCE TO RELATED APPLICATIONS

Current U.S. 2/18
Class:
Current A63B 71/14
International Class: CPC: A63B 71/14; A63B 71/06; A41D 19/015; A61F 5/01
Current CPC A63B/71/14; A41D 19/00; A63B 71/14; A63B
Class: 71/144; A63B 71/143; A41D 19/015; A61F 5/01; A71B 71/06
Field of 2/18, 161 A, 19, 16, 2/20
Search:

RELATED APPLICATIONS

| U.S. patent Documents | | |
|---|---|---|
| GB 2613831 A | June 2023 | Amanna |
| U.S. Pat. No. 320,972 | June 1885 | Rumsy. |
| U.S. Pat. No. 3,540,059 | November | Kennedy |
| U.S. Pat. No. 4,425,668 | January 1984 | Wen-Jen et al. |
| U.S. Pat. No. 6,014,770 | January 2000 | Spector |
| 6,202,213 B1 | March 2001 | Georgick |
| 11,344,788 B1 | May 2022 | Wittman |
| 0198920 A1 | August 2013 | Wittman |
| D732,747 S | June 2015 | Phillips et al. |
| 0114246 A1 | April 2020 | Poulin |
| 10376770 B2 | August 2019 | Wittman |
| 0210485 A1 | August 2012 | Clement et al. |
| 0173733 A1 | July 2011 | Krzeminski |
| U.S. Pat. No. 4,425,668 | January 1984 | Wen-Jen et al. |
| 6178553 B1 | January 2001 | Bolton |
| 0016153 A1 | January 2021 | Roddy |
| U.S. Pat. No. 7,134,146 | October 2006 | Westergaard |
| 0050191 A1 | February 2025 | Amanna |
| U.S. Pat. No. 2,817,088 | December 1957 | Vrana |
| U.S. Pat. No. 2,740,120 | April 1956 | Temple |
| U.S. Pat. No. 3,755,820 | September 1973 | Petrusek |

FEDERALLY SPONSORED RESEARCH AND DEVELOPMENT

Not applicable.

PRIOR ART

The present invention relates to protective gloves used in combat sports such as boxing, kickboxing, and mixed martial arts. Conventional boxing gloves typically rely on external thumb tethers or tabs to restrict excessive thumb movement. While these features may reduce hyperextension, they do not provide internal structural support or promote anatomically aligned fist formation.

Several prior art references disclose improvements in glove design. For example, U.S. Pat. No. 6,014,770 describes a training glove with wrist reinforcement features, and U.S. Pat. No. 10,376,770 discloses a molded hand protector with integrated padding and contoured design elements. These gloves address impact protection but do not incorporate an internal thumb channel that guides the thumb into a biomechanically aligned position within the glove structure. U.S. Pat. No. 4,425,668 eliminates the thumb entirely for simplified training use, while U.S. Pat. No. 3,540,059 includes an internal grip structure but does not provide a guided thumb path or thumb stabilization.

The cited references do not describe or suggest a glove system that includes: (1) a fixed internal thumb channel configured to promote anatomical fist formation; (2) a thumbhole aperture positioned to guide the thumb beneath the index and middle fingers; (3) a non-elastic, through-body wrist tightening strap that creates radial compression vectors; and (4) a butterfly-style forearm closure system providing circumferential compression; and (5) a biomechanically integrated compression system consisting of a thumb channel, wrist tightening strap, and forearm tightening system oriented in orthogonal planes and configured to function in mechanical cooperation to form an integrated compression system providing coordinated anatomical support across the hand, wrist, and forearm dynamically altering the rigidity of the glove body in response to user engagement and strike force. Furthermore, the prior art does not appear to teach such features in combination within a glove that retains the external profile of a traditional boxing glove while forming a continuous biomechanical linkage from the hand to the forearm.

In addition, some molded gloves used in martial arts training utilize air bladders jell or foam padding to reduce impact through force absorbance of said jell or foam inserts. They are not designed with pressure-responsive venting or threshold-tuned release mechanisms that reduce force through dissipation. Additionally, such force absorption systems typically lack integration with glove structure and do not provide coordinated biomechanical support. The present invention differs in that it includes an internal air-based energy dampening system-optionally incorporating a tunable valve or vent-configured to reduce transmitted force during impact. This feature is embedded within the glove's molded structure and operates in conjunction with anatomical contouring and active compression systems, providing a coordinated approach to user protection and energy management.

FIELD OF THE INVENTION

The present invention relates generally to protective handwear used in combat sports, and more specifically to boxing gloves designed for use in training and competitive environments. The invention is directed toward an anatomically configured glove structure that improves user safety and performance by enhancing hand alignment, thumb positioning, and joint stabilization. The invention further relates to boxing gloves incorporating region-specific compression features and, in some embodiments, energy management systems configured to reduce the transmission of impact forces during striking. The invention may be implemented using a range of manufacturing techniques suitable for producing flexible or semi-rigid glove structures.

BACKGROUND OF THE INVENTION

Conventional boxing gloves are typically constructed as passive enclosures composed of a shell, interior padding, and a closure mechanism. These gloves are primarily intended to cushion the user's hand and limit injury to opponents. However, such gloves lack mechanisms that dynamically respond to hand movement or strike force. They rely on static padding and loosely applied wrist closures, resulting in inconsistent rigidity and limited anatomical support. As a result, conventional gloves often permit excessive joint deviation, contribute to poor punch alignment, and increase the risk of trauma during use.

One of the recurring anatomical shortcomings of traditional glove designs is the ineffective alignment and stabilization of the thumb. Most gloves incorporate a loosely tethered thumb tab or compartment that does not guide the thumb into an anatomically correct fist or protected position. Improper thumb orientation can result in hyperflexion, dislocation, or injury to the metacarpophalangeal (MCP) joint. These issues are exacerbated during high-force impacts when internal hand structures are poorly supported.

Wrist and forearm support in prior glove designs is also limited. Common wrist closures-such as hook-and-loop straps that wrap externally around the wrist-focus primarily on securing the glove to the hand but do not apply compression in a biomechanically meaningful way. They often fail to distribute force across multiple anatomical regions, leading to instability during repeated strikes. Moreover, such systems do not activate the glove's internal structures or materials during tightening, and thus do not meaningfully improve glove-body cohesion or responsiveness.

Several prior art references attempt to address hand safety and support. For example, U.S. Pat. No. 10,376,770B2 discloses a glove incorporating splint-like elements to restrict finger movement. U.S. Pat. No. 3,540,059A incorporates stiffened glove segments to brace the hand, while U.S. Pat. No. 6,014,770A describes a training glove that immobilizes the thumb to reduce punch force. While these efforts attempt to reinforce the hand, they do so through structural restriction rather than anatomically guided alignment or dynamic engagement. They lack user-activated support systems that adapt during motion or impact.

U.S. Patent Application Publication No. US20250050191A1 (Amanna) provides an external wrist strap configuration that crosses over the dorsal side of the glove and affixes via hook-and-loop. While this system introduces dorsal reinforcement, it functions as an external stabilizer only and does not transmit compression through the glove body or incorporate glove-shell engagement. Its force profile remains limited to a linear or surface-level orientation.

Other wrist-based support systems include inflatable cuffs (U.S. Pat. No. 6,202,213B1), back-side strap placements (US20120210485A1), and external wraps (U.S. Ser. No. 10/376,770B2), yet these features are similarly focused on restraint rather than integration. They do not engage multiple anatomical regions simultaneously, nor do they adjust to different user anatomies or strike profiles in real time.

Likewise, molded gloves-common in martial arts training-often use single-structure foam but lack articulated thumb support, active compression zones, or energy-absorbing mechanisms. These gloves offer uniform cushioning but little anatomical control or dynamic fitment during training or competition conditions.

Need for Improvement

Despite incremental developments in glove safety and ergonomics, existing boxing gloves remain largely passive and uniform in construction. There remains a need for a glove that:

1. Facilitates proper anatomical fist formation through guided thumb positioning
2. Provides dynamic, region-specific compression across the hand, wrist, and forearm
3. Integrates internal and external structures into a responsive biomechanical support chain
4. Reduces transmitted impact forces through active dampening mechanisms
5. Maintains competitive visual and regulatory conformity

Summary Transition

The present invention addresses these needs by introducing a glove architecture that supports anatomically correct fist formation, stabilizes joint movement through active compression systems, and manages impact forces using tuned air-based dampening structures. Details regarding the structure, behavior, and integration of these systems are described in the Summary and Detailed Description that follow.

SUMMARY OF THE INVENTION

The present invention provides a boxing glove designed to enhance anatomical alignment, biomechanical control, and impact management through an integrated system of structural compression and dynamic response mechanisms. The glove is suitable for training and competitive use and may be constructed in either multi-component stitched or monolithic molded embodiments.

In a first aspect, the glove includes a fixed internal thumb channel that guides the thumb beneath the index and middle fingers. This channel is formed by a sewn or molded connection between the lateral edge of the thumb and the mitt portion of the glove, creating a concealed, anatomically correct path for anatomically correct fist formation. When a fist is formed, the thumb channel enables internal gripping of the palm/mitt material producing "fist tension" a user-generated constrictive force that draws the glove's padding and shell inward across the dorsal surface of the hand, reinforcing glove rigidity. This interaction transforms the glove from a passive container into a biomechanically active support structure that responds to user grip.

In a second aspect, the glove incorporates a through-body wrist tightening strap configured to generate radial compression. The strap is anchored laterally and routed through the glove body across the volar wrist surface before looping back to a pull-tab closure. This configuration draws the glove's padding and shell into compressive engagement with the wrist, creating two distinct pressure centers-one dorsal, formed by the inward displacement of the glove body, and one volar, formed by the strap's tension and closure-thereby improving wrist stability and reducing joint deviation under load.

In a third aspect, a butterfly-style forearm closure system is provided. This system comprises dual mirror-symmetric tightening straps, one of which passes through a strap slot in the other. This unique arrangement allows for simultaneous bilateral tensioning, producing anatomically balanced circumferential compression about the forearm. The closure adapts to varied forearm geometries and provides uniform radial sealing and consistent pressure distribution to stabilize the glove and enhance strike control.

In a fourth aspect, the glove features a biomechanically integrated compression system, wherein the thumb channel (providing fist tension), through-body wrist strap (providing radial compression), and butterfly tightening system (providing circumferential compression) act in concert to secure the glove across the hand, wrist, and forearm. These compression vectors interact independently and synergistically, transforming the glove into a multi-axial anatomical support framework that enhances rigidity, reduces misalignment, and improves energy transfer during striking.

In a fifth aspect, the molded embodiment of the glove optionally includes an internal air-based energy dampening system. This system comprises an air bladder or segmented air chamber positioned over the striking surface of the knuckles and configured with a vent or channel coupled to a tunable pressure threshold valve. When impact force exceeds a defined threshold, the valve releases air to reduce peak force transmission. This vented energy management system operates alongside the glove's padding and molded shell to reduce injury risk to both the user and the target.

All embodiments of the glove preserve the traditional visual and tactile characteristics required for competition, including molded faux seam impressions, grain surface textures, and conventional panel contours. The sewn and molded variations are structurally distinct but functionally unified by their shared anatomical compression and stabilization features.

Collectively, the structural innovations described herein provide a novel boxing glove that actively supports the user's biomechanics. The invention departs from conventional designs by integrating a multi-point, user-responsive compression systems that improve glove rigidity, enhance joint stability, and reduce transmitted impact forces.

DETAILED DESCRIPTION OF THE INVENTION

The present invention relates to a boxing glove having two main embodiments: a sewn traditional rendition and a molded version, both configured for use in training and competition. A third embodiment is a molded glove with an air-based energy-dampening system. Each embodiment is designed to improve anatomical alignment, enhance thumb stability, deliver radial wrist and circumferential forearm compression, and promote energy management through a combination of structural innovations. The glove converts passive fit features into active, biomechanically driven support mechanisms through coordinated force vector pathways established by the thumb channel, wrist tightening strap, and butterfly-style closure, as shown in FIGS. 1-5.

Figure 1:
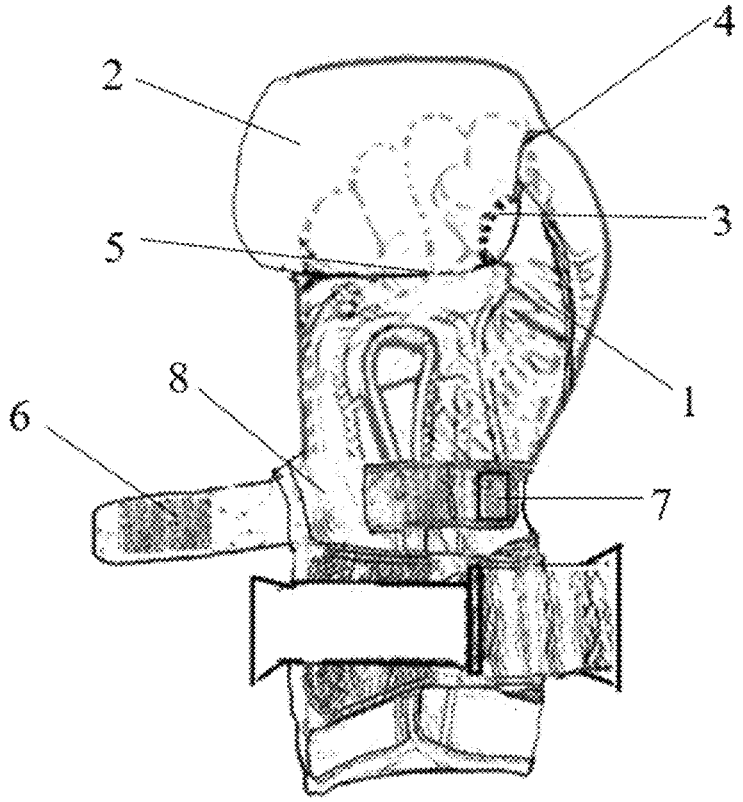
FIG. 1 is a palm-side view of the sewn embodiment of the boxing glove, illustrating the concealed curvature of the internal thumb channel positioned beneath the index and middle fingers. The thumbhole aperture located along the medial edge is indicated which allows for the formation of an anatomically proper fist.

Referring now to FIG. 1, a palm view of the sewn version of the glove shows a thumb channel 1 configured to promote anatomical fist formation and reduce thumb-related injury. The thumb channel is sewn to the glove body 8 in two places: a first sewn connection 4 along the lateral side of the thumb, replacing the traditional thumb tab, and a second sewn connection 5 joining the palm portion to the mitt section 2. The thumb channel 1 encases the thumb and consists of dual-stitched fabric or padded tubular material to maintain thumb orientation during striking. Internal padding within the thumb channel dampens lateral shear forces on the metacarpophalangeal joint. The thumb moves through the thumb channel 1, through the thumbhole aperture 3 and into the mitt section ending beneath the index and middle fingers in a curved, anatomically aligned path that allows for the formation of a proper fist. The interaction between the thumb and glove body creates fist tension. Fist tension is generated by gripping the palm material of the glove internally which constricts the shell and padding across the knuckle line, increasing glove rigidity during impact improving rigidity and dynamic control. This transforms the glove from a passive container into an active stabilizing structure responding to hand movement.

Figure 1A:
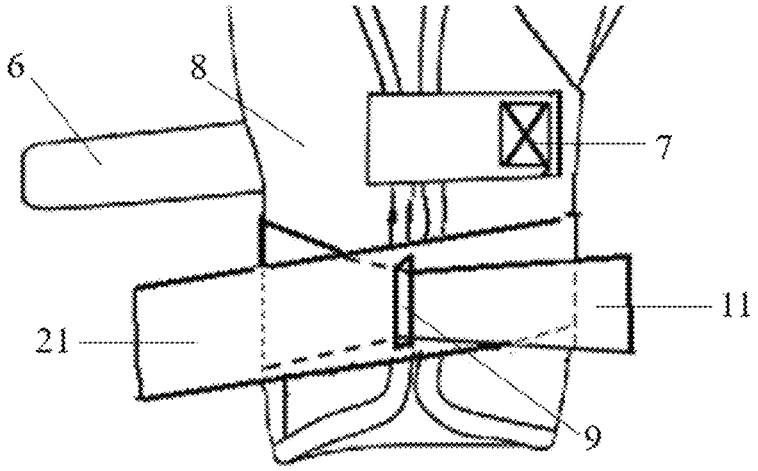
FIG. 1*a* is an enlarged palm-side view of the wrist region, illustrating the wrist tightening strap system and the butterfly-style forearm closure system. The drawing highlights the strap slot feature that enables anatomically balanced circumferential compression around the forearm.

In FIG. 1*a*, a palm-side expanded view shows the wrist tightening strap 6. The strap is anchored to the glove body 8 at a lateral anchor point 7 reinforced by stitching or molded features capable of withstanding at least 20 pounds of tensile force. The wrist strap 6 is routed through the glove body and wraps back upon itself creating a pull-tab closure. This configuration causes the glove's shell and padding to be drawn inward, producing radial compression with dual centers of pressure-one dorsally from glove displacement and one volarly from strap tension. This through-body routing constricts the glove padding and outer shell, transforming this portion of the glove into an active support structure which enhances anatomical alignment and improves strike stability and distinguishing the system from traditional external strap wrist wrap systems.

Figure 2:
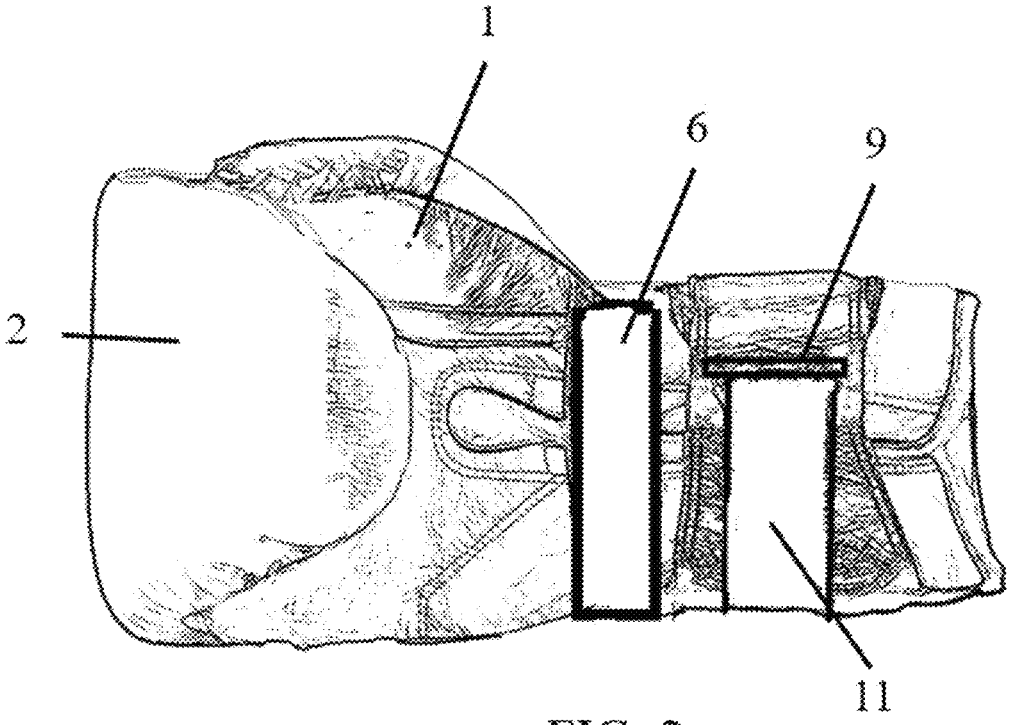
FIG. 2 is a palm-side view of the glove showing the thumb channel, wrist tightening strap, and butterfly-style tightening system in the closed position, illustrating their spatial integration across the glove's structure.
Figure 3:
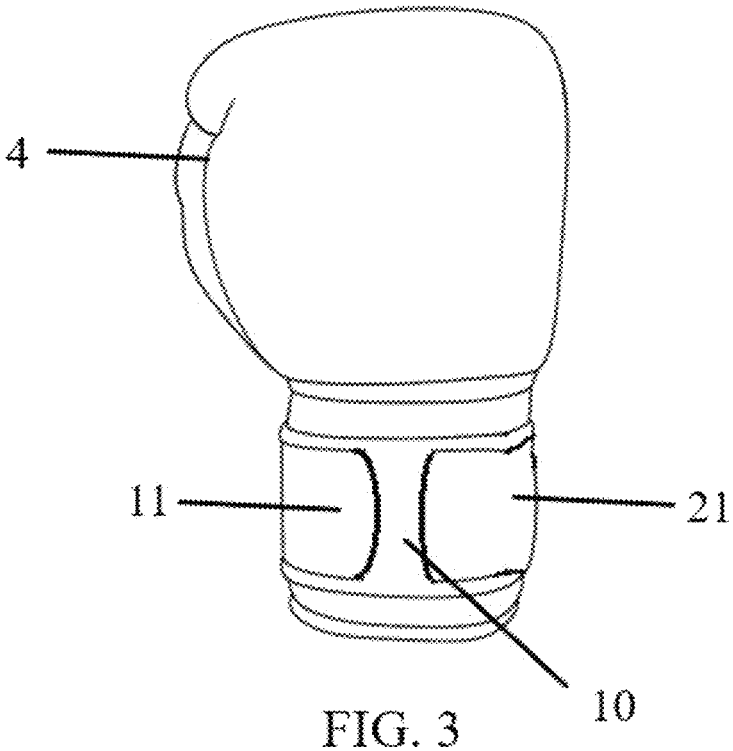
FIG. 3 is a dorsal (back) view of the glove showing the hook-and-loop fastening mechanism. The figure also highlights the first sewn connection of the thumb channel, which eliminates the need for an external thumb tab. The attachment geometry of the butterfly tightening straps is also shown.

Referring to FIGS. 1*a*, 2, and 3, the butterfly-style tightening straps (11 and 21) function in tandem with the wrist strap in affixing the glove to the hand and forearm. The butterfly-style mirror-symmetric tightening straps allows one strap to pass through the strap slot 9 in the opposing tightening strap to form a circumferential compression loop. When tensioned bilaterally, the butterfly-style tightening straps are configured to produce a circumferential compression vector around the forearm, applying anatomically balanced force across both the dorsal and volar surfaces which applies uniform pressure about the dorsal and volar forearm surfaces, creating a radial seal. A hook-and-loop fastener 10 secures the tightening straps, with the soft-loop side located on the glove body 8 and the hook elements on the straps to enhance comfort and reduce abrasion. The system conforms to a variety of forearm sizes and stabilizes the glove under strike forces. Each embodiment may also have a wrist/ forearm external hood common in competition boxing gloves that cover the wrist and forearm compression straps (not shown).

Figure 4:
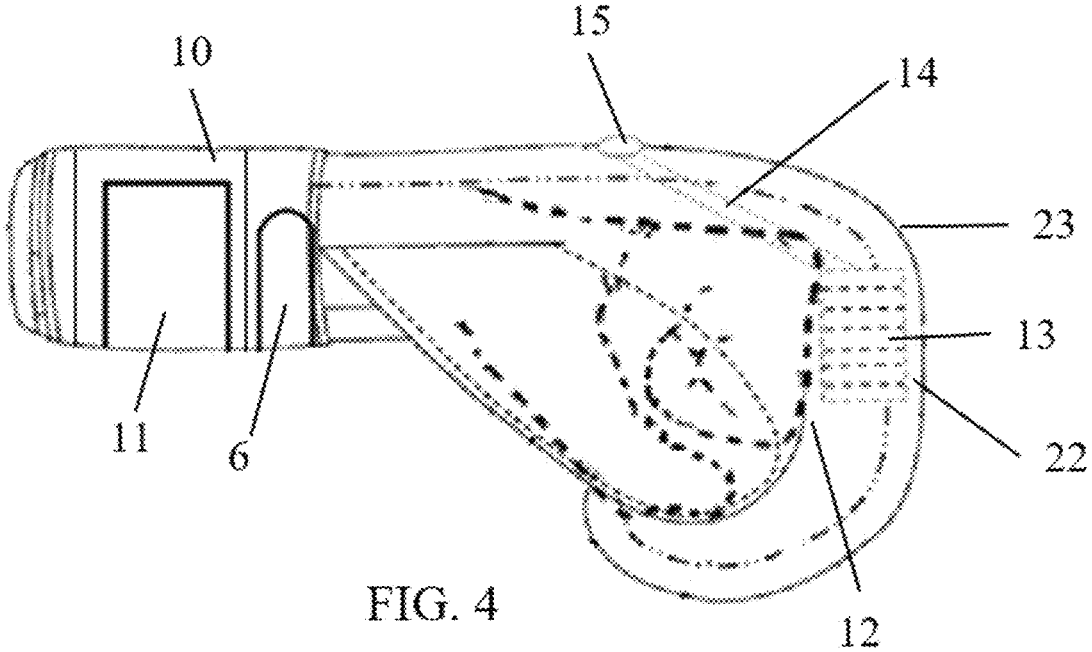
FIG. 4 is a cross-sectional side view of the molded embodiment of the glove, illustrating the integrated air-based energy dampening system. The internal air chamber, air vent tube, and pressure-sensitive valve are shown in relation to the knuckle impact zone.

Referring now to FIG. 4, a cross-sectional view illustrates the air-based energy dampening system incorporated into the molded glove embodiment. The dampening system comprises a segmented bladder 13 situated between the striking surface of the knuckle region between the glove mitt padding 22 and the external shell 23. The bladder may be a single compressible area, a honeycomb structure or include multiple compressible chambers designed to deform non-linearly under load. Connected to the bladder(s) is an air vent tube 14 leading to a pressure-release valve 15 configured to expel air when internal pressure exceeds a predefined threshold. This controlled venting dissipates impact energy, reducing transmitted force to both the glove wearer and target. The air dampening system operates in concert with the glove's anatomical compression zones, improving strike safety and energy dissipation.

Figure 5:
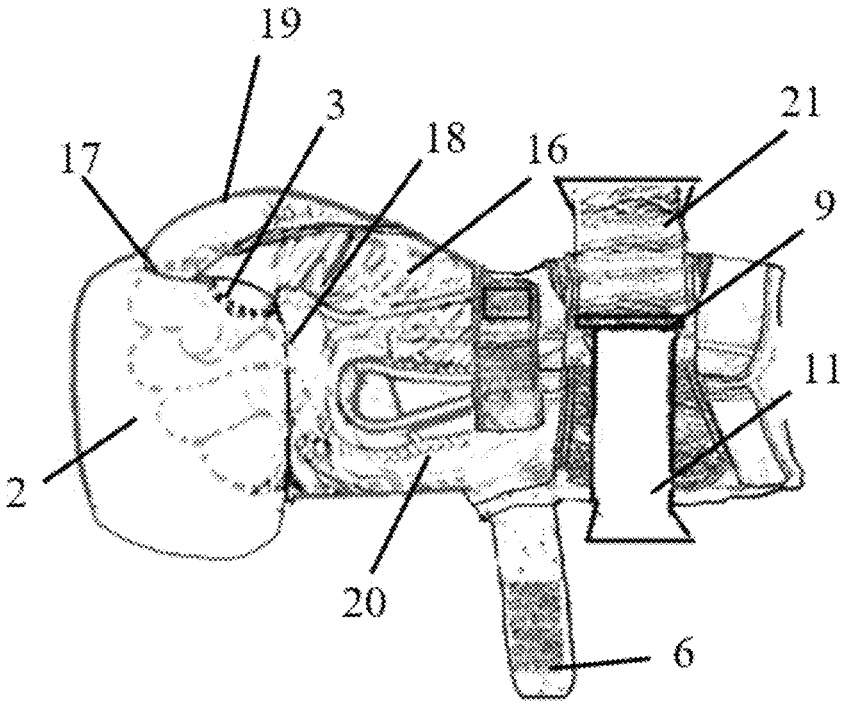
FIG. 5 is a palm-side view of the molded embodiment of the glove, showing the concealed molded thumb channel beneath the index and middle fingers, the integrated anatomical structure, and the external molded surface including faux seam impressions and grain texturing designed to mimic traditional glove aesthetics.

Referring now to FIG. 5, a palm-side view of the molded embodiment is shown. The glove comprises a monolithic molded glove body formed from self-skinning foam, elastomeric rubber, silicone, epoxy resin, or combinations thereof. A molded anatomical thumb channel 16 is integrally formed within the glove body, guiding the thumb beneath the index and middle fingers. The channel includes a first molded connection 17 between the lateral side of the thumb and the glove body and a second molded connection 18 that joins the palm portion to the mitt section. The thumb enters through a thumbhole aperture 3 and is directed beneath the index and middle fingers along a concealed curved path, promoting anatomical fist formation and enabling fist tension.

The molded version includes faux seam impressions 20 and surface grain texture to simulate the appearance of a traditional competitive glove. Number 19 shows the thumb profile which is molded to the mitt and presents the same visual look as a traditional thumb boxing glove. Additional anatomical shaping is provided through finger curvature contours 12 (see FIG. 4) with integrally molded thumb channel 16, aligning glove geometry with human hand anatomy to improve user comfort and reduce fatigue while producing fist tension. The wrist tightening strap 6, lateral anchor point 7 (see FIG. 1) and butterfly-style tightening straps 11 and 21 with strap slot 9 and fastener 10 (see FIG. 3) are integrally formed or attached in the molded version, configured to provide anatomically balanced wrist and forearm compression. These systems operate in orthogonal planes to form a biomechanically integrated compression system, coordinating anatomical support across the hand, wrist, and forearm. Together with the air dampening system, this configuration reinforces glove stiffness under load, stabilizes joint motion, and reduces transmitted force during impact.

The following table provides a cross-reference of numbered components used in the figures and their corresponding descriptions for clarity:

Component Number Cross-Check Table

| # | Component Description | Status |
|---|---|---|
| 1 | Thumb channel | Described clearly; cited in sewn and molded versions (FIG. 1 & FIG 2) |
| 2 | Mitt section of glove | Included within internal cavity descriptions; discussed in all claims shown in (FIG. 1, 2 & FIG. 5) |
| 3 | Thumbhole aperture | Integrated into anatomical path language; shown in FIG. 1 & FIG. 5 |
| 4 | First sewn connection (lateral side of thumb) | Covered in sewn embodiment (FIG. 1 & FIG. 3); claim 1 support |
| 5 | Second sewn connection (palm region) | Included in sewn description; matches glove-mitt coupling for thumb channel shown in FIG. 1 |
| 6 | Wrist tightening strap | Fully detailed; described for both sewn and molded forms (FIG. 1, 1a, 2, 4, 5) |
| 7 | Lateral anchor point for wrist strap | Described; tensile strength noted (20 lbs.); located in FIG. 1 & 1a |
| 8 | Glove body | Referred throughout; foundation for all embodiments (FIG. 1 & 1a) |
| 9 | Strap slot (butterfly system) | Properly referenced in forearm system (FIG. 1a, 2 & 5) |
| 10 | Hook-and-loop fastener (butterfly closure) | Explained in compression fastener logic; comfort and function noted (FIG. 3) |
| 11 | Butterfly tightening strap (Forearm) | Cited in strap-slot threading and compression mechanism (FIG. 1a, 2, 3 & 5) |
| 12 | Finger curvature contouring | Covered in molded glove (FIG. 4); supports anatomical design |
| 13 | Shock absorption system (Segmented bladder) | Fully described in air/energy-dampening system (FIG. 4) |
| 14 | Air vent tube | Part of air-based energy dampening system (FIG. 4) |
| 15 | Pressure threshold valve | Part of air-based energy dampening system; controls air release under impact (FIG. 4) |
| 16 | Molded thumb channel | Differentiated from sewn version; integrally formed (FIG. 5) gives appearance of traditional thumb boxing glove |
| 17 | First molded connection (lateral thumb) | Mirrors sewn connection (FIG. 5) |
| 18 | Second molded connection (palm region) | Complements 17 for thumb channel security (FIG. 5) |
| 19 | External molded profile | Thumb is molded to the mitt and looks like a traditional thumb boxing glove (FIG. 5) |
| 20 | Faux seam impressions | Molded aesthetics described; ensures traditional look (FIG. 5) |
| 21 | Butterfly tightening strap (Forearm) | Completes mirror symmetry with 11; compression described (FIG. 1a, 3 & 5) |
| 22 | Internal padding between bladder and shell | Referenced in energy dissipation and structural support (FIG. 4) |
| 23 | Glove shell (outer structure) | Central in describing compression and glove-body reinforcement (FIG. 4) |

The invention claimed is:

1. A boxing glove for use in training or competition, comprising:

an internal glove cavity including a mitt section and a thumb channel;

a thumbhole aperture positioned along a medial edge of the glove, the aperture forming an internal entry to the mitt;

a thumb channel element positioned within the glove body, forming a concealed internal passage from the thumb channel through the thumbhole aperture into the mitt portion, the thumb channel element extending beneath the index and middle fingers when worn;

a first connection along a lateral side of the thumb channel element and a second connection between the thumb channel element and the palm region of the mitt;

wherein the glove is constructed as either a multi-component stitched assembly or a monolithic molded structure composed of foam, rubber, silicone, epoxy, or a self-skinning elastomeric material, the molded structure including the channel element integrally formed within the glove body.

2. The boxing glove of claim 1, wherein the thumb channel element is configured to guide the thumb beneath the index and middle fingers along a curved, anatomically aligned path, and wherein the engagement of the thumb channel element and palm region when gripped internally constricts a glove dorsal shell padding during fist formation generating fist tension.

3. The boxing glove of claim 1, wherein the thumb channel element comprises a concealed structure formed by dual sewn or molded connections, including a palm-side connection that enables engagement with the mitt region, wherein such engagement constricts the shell and padding across the knuckle line to increase glove rigidity during impact.

4. The boxing glove of claim 1, wherein the thumb channel includes internal padding or tubular reinforcement providing anatomical alignment and dynamic tension through the thumbhole aperture located medially within the mitt region providing proper anatomical fist formation reducing reduce hyperflexion and metacarpophalangeal joint instability.

5. A boxing glove for use in training or competition, comprising:

an internal glove cavity for receiving a user's hand and wrist;

a thumb channel element positioned within the glove body, forming a concealed internal passage from a thumb channel through a thumbhole aperture into the mitt portion, the thumb channel element extending beneath the index response and middle fingers, when worn;

a wrist tightening strap system configured to provide radial compression and anatomical wrist stabilization during striking;

wherein the wrist tightening strap extends from a lateral anchor point, is routed through the glove body across the volar surface of the wrist, and doubles back upon itself to form a pull-tab closure;

wherein the routing of the wrist tightening strap through the glove body causes the glove's shell and padding to be drawn inward toward the wrist, producing radial compression with two distinct centers of support pressure-one at the dorsal surface of the wrist formed by displacement of the glove body, and another at the volar surface formed by strap tension and closure;

wherein the glove is constructed as either a multi-component stitched assembly or a monolithic molded structure composed of foam, rubber, silicone, epoxy resin, or self-skinning elastomeric materials;

wherein the through-body strap design integrates the wrist region of the glove into an active compression mechanism that reinforces joint stability under dynamic striking loads.

6. The boxing glove of claim 5, wherein the wrist tightening strap comprises a woven, non-elastic textile or molded polymer band selected to maintain consistent tension during use, and wherein the lateral anchor point of the wrist strap is reinforced with stitching or molded retention features capable of withstanding tensile forces of at least 20 pounds.

7. The boxing glove of claim 5, wherein the strap's pull-tab closure includes a hook-and-loop fastener positioned to allow independent adjustment of radial compression intensity, and wherein the inward pull of the wrist strap applies an asymmetrical force across the glove body to stabilize the wrist and reduce hyperflexion, hyperextension, and lateral deviation during impact.

8. The boxing glove of claim 5, wherein the through-body routing of the wrist strap causes the wrist padding and external shell to compress against the dorsal wrist to form a dorsal compression center, and wherein the strap's return loop applies tension directly to the volar surface of the wrist to create a volar compression center aligned with the user's carpal joint, such that the dual compression centers enhance proprioceptive feedback and glove-to-wrist coupling during striking motion.

9. A boxing glove for use in training or competition, comprising:

an internal cavity configured to receive a user's hand and wrist;

a glove body including a mitt portion, a wrist portion, and a forearm portion;

a thumb channel element positioned within the glove body, forming a concealed internal passage from a thumb channel through a thumbhole aperture into the mitt portion, the thumb channel element extending beneath the index Per IDC and middle fingers, when worn;

a butterfly-style forearm closure system comprising:

a first tightening strap and a second tightening strap, each anchored on opposing sides of the forearm portion of the glove body;

a strap slot formed in one of the tightening straps and configured to allow the other tightening strap to pass through;

a fastening mechanism configured to receive and secure the tightening straps after tensioning;

wherein the butterfly-style closure system is configured to apply anatomically balanced circumferential compression around the user's forearm by drawing both tightening straps evenly across dorsal and volar surfaces;

and wherein the glove is constructed as either a multi-component stitched assembly or a monolithic molded structure composed of foam, rubber, silicone, epoxy, or a self-skinning elastomeric material.

10. The boxing glove of claim 9, wherein the butterfly-style tightening straps are configured to produce a circumferential compression vector around the forearm, applying anatomically balanced force across both the dorsal and volar surfaces, and wherein the strap slot is dimensioned to enable the opposing tightening strap to pass through without folding or twisting, thereby facilitating simultaneous bilateral pulling that generates a continuous radial seal around the forearm.

11. The boxing glove of claim 9, wherein the tightening straps are anatomically contoured to follow the natural curvature of the forearm and configured to prevent buckling or slippage under tension and wherein the circumferential compression system is configured to engage the glove's structural shell and underlying padding to create active forearm coupling that improves strike alignment and energy continuity.

12. The boxing glove of claim 9, wherein the circumferential compression is configured to engage the glove's structural shell and underlying padding to create active forearm coupling that improves strike alignment and energy continuity, and wherein the fastening mechanism comprises a low-profile hook-and-loop fastener disposed on at least one tightening strap to secure the circumferential compression after tensioning, thereby reducing glove migration during striking and enhancing biomechanical stability across the wrist-forearm interface, when worn.

13. A boxing glove comprising a biomechanically integrated compression system for use in training or competition, the glove comprising:

an internal glove cavity including a mitt section, wrist section, and forearm section;

an anatomical thumb channel configured to guide the thumb beneath the index and middle fingers through a thumbhole aperture to enable fist tension during fist formation a thumb channel element positioned within the glove body, forming a concealed internal passage from said thumb channel through the thumbhole aperture into the mitt portion, the thumb channel element extending beneath the index and middle fingers, when worn;

a wrist tightening strap extending from a lateral anchor point, routed through the glove body and across the volar surface of the wrist, and configured to apply radial compression about the wrist, thereby generating uneven radial compression with dual centers of support pressure—one dorsally from the glove padding and shell being drawn inward, and one volarly from strap tension—providing joint stabilization during impact;

a butterfly-style forearm tightening system comprising two opposing tightening straps, one of which passes through a strap slot formed in the other strap, and a fastening mechanism configured to secure the system after tensioning, the tightening straps configured to apply anatomically-balanced circumferential compression around the forearm and form a radial seal across both dorsal and volar surfaces;

wherein the thumb channel element, wrist tightening strap, and forearm tightening system are oriented in orthogonal planes and configured to function in mechanical cooperation to form a biomechanically integrated compression system providing coordinated anatomical support across the hand, wrist, and forearm, and dynamically altering the rigidity of the glove body in response to user engagement and strike force;

wherein the glove is constructed as either a multi-component stitched assembly or a monolithic molded structure composed of foam, rubber, silicone, epoxy resin, or a self-skinning elastomeric material, the molded structure including integrally formed versions of the thumb channel element, wrist strap routing, and forearm tightening features to replicate the biomechanical compression behavior of the stitched configuration, while maintaining the external appearance of a traditional boxing glove.

14. The boxing glove of claim 13, wherein the thumb channel element is configured to draw glove padding and shell toward the dorsal hand during fist formation working independently and in conjunction with the pull-tab wrist tightening strap enabling two distinct centers of compression: a dorsal pressure center caused by the glove body's shell and padding being drawn inward, and a volar pressure center created by the strap's retraction and closure working independently and in conjunction with the butterfly-style tightening system configured for simultaneous bilateral pulling using one or both hands to create an even, circumferential compression loop.

15. The boxing glove of claim 13, wherein the butterfly-style tightening system comprises anatomically contoured tightening straps configured for bilateral simultaneous pulling using one or both hands, and a strap slot geometry that maintains even tension distribution by allowing one strap to pass through the other without buckling, thereby applying balanced pressure to both dorsal and volar surfaces and forming a radial seal that reduces glove slippage and enhances energy continuity during striking.

16. The boxing glove of claim 13, wherein the integrated compression components—the thumb channel element, wrist tightening strap, and butterfly-style system—are arranged in orthogonal anatomical planes configured to stabilize motion across flexion, extension, and rotational axes, and wherein the biomechanical compression system transforms static glove elements into active anatomical supports that dynamically stiffen under user engagement and strike force, improving glove fit, reducing joint stress, and maintaining alignment of the user's hand, wrist, and forearm.

17. A boxing glove for use in training or competition, comprising:

a monolithic molded glove body formed from a material selected from the group consisting of self-skinning foam, elastomeric rubber, silicone, epoxy resin, or combinations thereof;

an internal glove cavity including a mitt section, a wrist section, and a forearm section; a molded anatomical thumb channel element extending beneath the index and middle fingers, when worn, integrally formed within the glove body and configured to guide the user's thumb beneath the index and middle fingers through a concealed path, the thumb channel element including a thumbhole aperture positioned along a medial edge of the glove and configured to allow entry into the mitt section, thereby enabling fist tension during fist formation;

a radial wrist tightening strap extending through the glove body and looping back upon itself, wherein tensioning the strap causes the glove's shell and padding to be drawn inward toward the wrist, producing radial compression with two distinct centers of support pressure-one at the dorsal surface of the wrist formed by displacement of the glove body, and another at the volar surface formed by strap tension and closure;

a butterfly-style forearm tightening system comprising two opposing tightening straps, one of which passes through a strap slot formed in the other strap, and a fastening mechanism configured to secure the system after tensioning, the tightening system being configured to apply anatomically-balanced circumferential compression around the forearm;

an air-based energy dampening system integrally formed within the mitt section of the glove body, comprising an internal air bladder positioned over the striking surface of the knuckle region, and a vent or channel coupled to a pressure-responsive valve configured to release air when an impact force exceeds a predefined threshold, thereby dissipating strike energy;

wherein the thumb channel, wrist strap, and forearm tightening system are positioned in orthogonal anatomical planes and cooperate to form a biomechanically integrated compression system that dynamically reinforces the glove body during use;

wherein the glove body includes molded anatomical contours aligned with a user's finger curvature, knuckle line, and wrist positioning, and is externally contoured with faux seam impressions and surface texture so as to mimic the appearance of a traditional competitive boxing glove.

18. The boxing glove of claim 17, wherein the air bladder comprises a single chamber, segmented, or honeycomb-like structure configured to compress non-linearly under variable impact loads, and wherein the air vent includes a flexible diaphragm or tunable pressure-release valve configured to release air once a predefined pressure threshold is exceeded, and wherein the air bladder and anatomical compression systems operate in tandem to enhance shock absorption and reduce transmitted impact force by maintaining glove alignment during strike engagement.

19. The boxing glove of claim 17, wherein the molded anatomical thumb channel element includes a recessed groove geometry and surface texturing to maintain thumb orientation beneath the index and middle fingers and reduce slippage during striking, and wherein the wrist tightening strap is routed through the glove body such that tensioning the strap creates two distinct pressure centers—one dorsally from glove shell displacement and one volarly from strap tension overlap—and wherein the butterfly-style tightening system comprises anatomically contoured opposing straps configured to pass through a strap slot and, when bilaterally pulled, apply uniform circumferential compression across dorsal and volar forearm surfaces.

20. The boxing glove of claim 17, wherein the thumb channel element, wrist strap, and forearm tightening system enable the generation of dynamic fist tension that constricts the glove's padding and shell to stiffen the glove body under impact, and wherein the three systems are positioned on orthogonal anatomical planes configured to function independently and cooperatively to dynamically adjust glove stiffness and strike alignment during punching, and wherein the molded glove body includes faux seam impressions, grain texturing, and contour lines to replicate the external appearance of a traditional leather glove, providing compliance with competitive boxing standards.

* * * * *